US006125735A

United States Patent [19]

Guhring

[11] Patent Number: 6,125,735

[45] Date of Patent: Oct. 3, 2000

[54] SELF-LOADING WEAPON

[75] Inventor: Manfred Guhring, Oberndorf/Neckar, Germany

[73] Assignee: Heckler & Koch GmbH, Oberndorf/Neckar, Germany

[21] Appl. No.: 09/294,632

[22] Filed: Apr. 19, 1999

Related U.S. Application Data

[63] Continuation of application No. PCT/EP97/05717, Oct. 16, 1997.

[30] Foreign Application Priority Data

Oct. 21, 1996 [DE] Germany ..... 196 43 377

[51] Int. Cl.[7] ..... F41A 19/33

[52] U.S. Cl. ..... 89/141; 89/140; 89/142; 89/148; 42/69.03

[58] Field of Search ..... 89/129.02, 131, 89/140, 141, 142, 128, 144, 148, 151; 42/69.03

[56] References Cited

U.S. PATENT DOCUMENTS

| | | | |
|---|---|---|---|
| 3,045,555 | 7/1962 | Stoner | 89/142 |
| 3,292,492 | 12/1966 | Sturtevant | 89/128 |
| 3,301,133 | 1/1967 | Sturtevant | 89/131 |
| 3,345,914 | 10/1967 | Newcomb et al. | 89/129 |
| 4,004,496 | 1/1977 | Snodgrass et al. | 89/129 |
| 4,523,509 | 6/1985 | Thevis et al. | 89/131 |
| 5,913,261 | 6/1999 | Guhring et al. | 89/141 |

FOREIGN PATENT DOCUMENTS

| | | | |
|---|---|---|---|
| 295357 | 12/1971 | Germany | 89/128 |
| 626717 | 11/1981 | Switzerland | 89/129.02 |

OTHER PUBLICATIONS

European Patent Office, *PCT International Search Report*, dated Oct. 3,1998 in connection with PCT Patent Application Serial No. PCT/EP97/05717, the parent of this application.

*Primary Examiner*—Stephen M. Johnson
*Attorney, Agent, or Firm*—Marshall, O'Toole, Gerstein, Murray & Borun

[57] ABSTRACT

A fully automatic self-loading weapon is disclosed. The weapon has a functional part that can be moved by the release of a round, and a connectable and disconnectable single-shot device which, when activated, causes release of one shot for every actuation of the weapon trigger. To restrict the number of rounds of a burst to only two rounds, after release of one round with the single-shot device disconnected, the movement of the functional part automatically activates the single-shot device so that only a single additional round is released.

37 Claims, 2 Drawing Sheets

SELF-LOADING WEAPON

RELATED APPLICATION

This application is a continuation of PCT/EP97/05717 which was filed on Oct. 16, 1997.

FIELD OF THE INVENTION

The invention relates generally to automatic weapons, and, more particularly, to a fully automatic self-loading weapon with a functional part which moves in response to the release of a round to connect a single-shot device to thereby ensure the automatic weapon fires only two shots for a single actuation of the trigger.

BACKGROUND OF THE INVENTION

As used herein, positional terms such as "front", "top", etc. refer to a weapon held in the normal fining position with the bore of the weapon held in a generally horizontal position. Under this convention, "front" points in the direction of firing.

A switchable single-shot device is often provided in fully automatic self-loading weapons, especially in small arms, but also in machine guns, etc. The single-shot device is designed to permit release of only a single round after it is engaged. A shot selector is provided which makes it possible for the shooter to operate the weapon in either the single-shot or the sustained firing mode.

The single-shot mechanism is generally controlled by a functional part of the weapon, but can also include an independent control mechanism such as a delay mechanism. This type of delay mechanism ensures that, after release of a round, the connection between the trigger, (which is still pulled back), and a locking device is interrupted immediately after the round is released. This interruption permits the locking device to hold back the hammer or the firing pin piece (in the case of a weapon which has a closed breech in the ready to fire condition (e.g., the M16 rifle)) or the breech (in the case of a weapon which has an open breech in the ready to fire condition (e.g., the M3 submachine gun commonly referred to as the "grease gun")) in order to prevent release of a second round.

Whereas it is possible in sustained fire to cover terrain sections and force the opponent to take cover, single shots are prescribed for precise individual firing. However, it has turned out that the chances of hitting a single target are improved if the target is brought under sustained fire. However, only the first rounds of a burst are typically on target. The subsequent rounds, on the other hand, are more or less far from the target because the weapon migrates as a result of recoil and, under some circumstances, can pose a threat to persons who are situated close to the firing line. Moreover, excessive, ultimately unsuccessfully released rounds are undesirable because they reduce the cartridge supply of the shooter.

It is certainly possible for a trained shooter to release any desired short bursts of rounds (e.g., only two or three rounds) without difficulty. However, when the shooter concentrates on limiting the shots to such a small number during firing, the amount of attention directed toward the actual target is reduced. Moreover, weapons generally should be designed so that even less trained persons can handle them perfectly.

To remedy this problem the applicant has developed, among other things, devices that are capable of releasing extremely precise single shots and are additionally equipped with a three-shot mechanism that can be selected by a shot selection lever to ensure that a burst of precisely three rounds is released during activation of the trigger. However, this three-shot mechanism is relatively complicated.

The applicant has developed a trigger device which, like the trigger device of the G3 weapon, has a longitudinally shiftable and pivotable trigger lever located on the top of the trigger. The trigger lever causes the interruption process in single-shot use. If the trigger is released and the front tip of the trigger lever has fallen into the corresponding locking recess of the hammer, which is therefore secured, then the hammer forces the trigger lever down so that it is situated with its rear end above a protrusion of the trigger. The protrusion in turn is situated behind the pivot point of the trigger.

If the trigger is now pulled rearwardly by the shooter, the protrusion is moved upward, which in turn engages beneath the rear end of the trigger lever and pivots the front end of the trigger lever downward and out of engagement with the locking recess of the hammer. The hammer backs off and at the same time the trigger lever is pushed forward so that it slides with its rear end forward from the protrusion and assumes its original pivot position in which it can again engage in the hammer lock recess.

The hammer now forces the trigger lever rearward again, but the rear end of the trigger lever is situated on the front side of the protrusion of the trigger, which is still pulled back.

If the trigger is now released, the protrusion moves downward beneath the trigger lever. The trigger lever is, thus, released and forced rearward by the hammer. The initial position before release of the shot is, therefore, reproduced.

However, whereas the trigger must be pulled back again in the G3 weapon in sustained firing as during single firing in order to pivot the front end of the trigger lever downward so that it cannot fall into the locking protrusion when it is released from the protrusion of the trigger, in the trigger device of the applicant the trigger assumes the same pivot position during sustained firing as during single firing. Instead of pivoting the trigger lever out from engagement with the hammer, it is prevented by a slide from sliding in front of the protrusion of the trigger. The slide therefore forms part of the shot selection device in the applicant's device.

SUMMARY OF THE INVENTION

In accordance with an aspect of the invention, a mode control assembly is provided for use in an automatic self-loading weapon having a trigger assembly which, when its motion is unimpeded, will release a single round for each actuation of an associated trigger. The mode control assembly comprises a first lever in operative engagement with the trigger assembly. The first lever has a first state wherein the first lever moves with the trigger assembly without impeding the motion thereof such that the trigger assembly will release a single round for each actuation of the associated trigger. The first lever has a second state wherein the first lever impedes at least one movement of the trigger assembly. The mode control assembly also includes a catch in operative engagement with the first lever to selectively convert the state of the first lever between the first and the second states. Additionally, the mode control assembly is provided with an actuator in operative engagement with the catch. When the first lever is in the second state during a first shot, the actuator and the catch cooperate to convert the state of the first lever from the second state to the first state to thereby ensure that only two rounds are released for a single actuation of the trigger.

In some embodiments, the actuator comprises a projection on a hammer.

In some embodiments, the first lever comprises a slide, the catch selectively secures the slide against movement to define the second state of the first lever, and the catch is positioned to be displaced by the actuator to release the slide such that the state of the first lever changes from the second state to the first state.

In some embodiments, the mode control assembly also includes a contact positioned within the motion path of a hammer and a spring disposed between the contact and the catch such that the contact can be forced out of the motion path during a cocking motion of the hammer and can be entrained by the hammer during a striking motion of the hammer to displace the catch and to thereby convert the state of the first lever from the second state to the first state.

In accordance with another aspect of the invention, an automatic firearm is provided. The firearm includes a hammer for reciprocating between a loaded position and a discharged position. The hammer is biased toward the discharged position. The firearm also includes a trigger assembly in operative engagement with the hammer to selectively secure the hammer in the loaded position. The trigger assembly has a first mode wherein the trigger assembly permits the hammer to move from the discharged position through the loaded position and back to the discharged position without interference. It also has a second mode wherein the trigger assembly secures the hammer in the loaded position when the hammer moves from the discharged position to the loaded position. The firearm is also provided with a mode control assembly in cooperative engagement with the trigger assembly to select the mode of the trigger assembly. Additionally, the firearm includes an actuator cooperating with the mode control assembly to selectively convert the mode of the trigger assembly from the first mode to the second mode after discharge of a first shot to thereby ensure two shots are fired for one actuation of the trigger assembly.

In some embodiments, the mode control assembly has a two shot state wherein the mode control assembly converts the mode of the trigger assembly from the first mode to the second mode, and the mode control assembly has a single shot state wherein the mode control assembly maintains the trigger assembly in the second mode.

In the preferred embodiment, the trigger assembly further comprises a trigger, a trigger lever, and a trigger lever spring. The trigger lever has a first condition wherein the movement of the trigger lever has only a rotational component, and a second condition wherein the movement of the trigger lever has both a rotational component and a longitudinal component. The trigger lever spring biases the trigger lever into engagement with the hammer.

In the preferred embodiment, the mode control assembly further comprises a slide, a catch and a movable contact. The slide is mounted for movement between a proximal position and a distal position. The slide secures the trigger assembly in the first mode when the slide is secured in the proximal position. The catch is mounted for movement between a first position wherein the catch secures the slide in its proximal position, and a second position wherein the catch permits the slide to reciprocate between its proximal and distal positions. The movable contact cooperates with the actuator and the catch to selectively move the catch from the first position to the second position to convert the mode of the trigger assembly from the first mode to the second mode.

In the preferred embodiment, the firearm is also provided with a shot selection shaft which is in operative engagement with the catch. The shot selection shaft has a first shaft position wherein the catch is secured in the second position and a second shot shaft position wherein the catch is free to move between the first and the second positions.

Other features and advantages are inherent in the apparatus claimed and disclosed or will become apparent to those skilled in the art from the following detailed description and its accompanying drawings.

DESCRIPTION OF THE PREFERRED EMBODIMENT

As used herein, the term "functional part" is understood to mean a weapon element that is moved by the energy released during the firing of a round (e.g., the barrel, a gas cylinder, the breech, or other parts necessarily moved by one or more of these elements, for instance, a hammer, etc). A solid body whose movement is fully mechanically independent of the barrel and breech can also form such a functional part, if during the recoil motion of the weapon, which occurs as a result of release of a round, the solid body attempts to preserve its position and is consequently displaced relative to the weapon.

Figure 1:
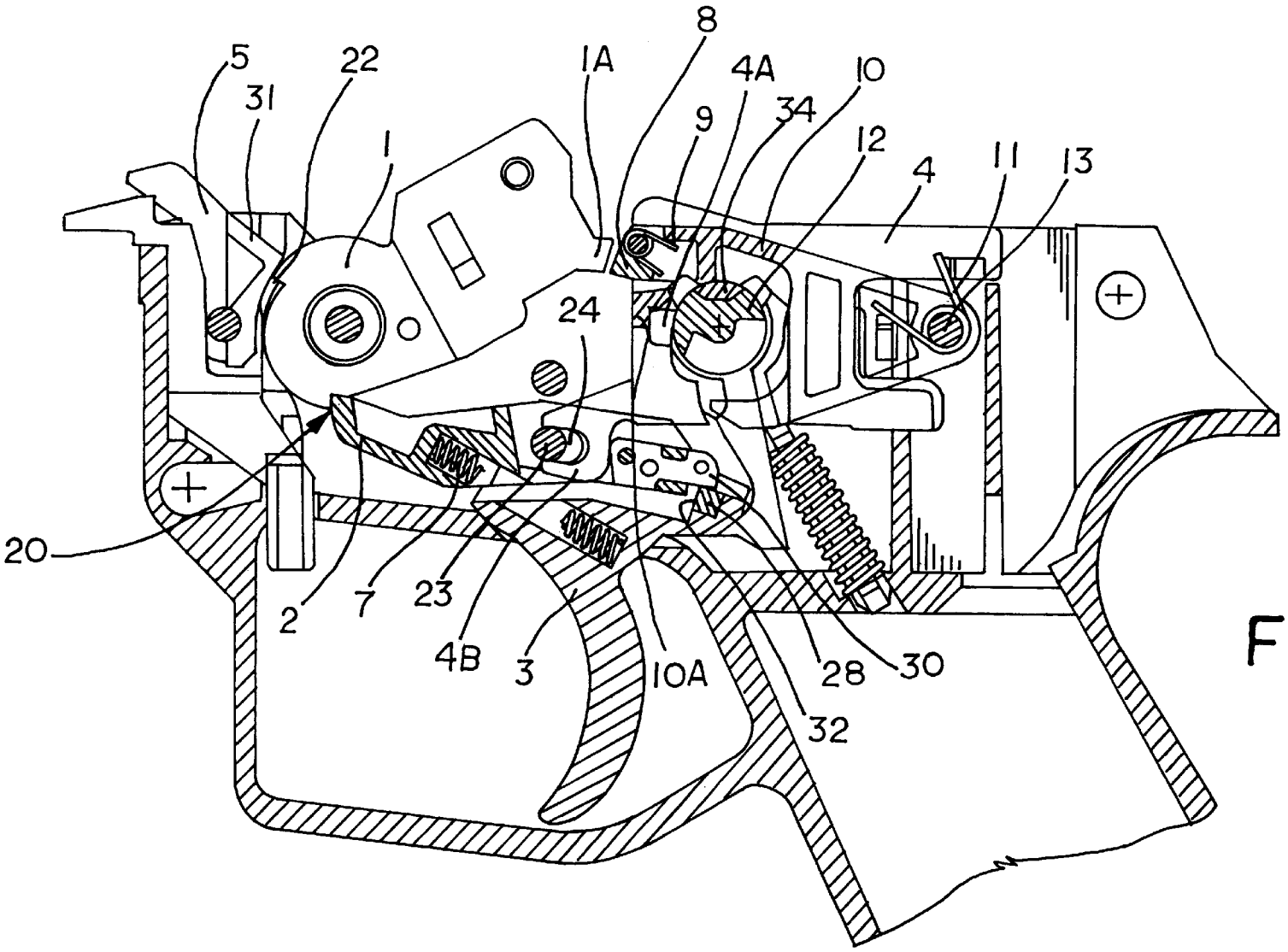
FIG. 1 is a longitudinal cross-sectional illustration through a handle of an automatic weapon equipped with a two-shot device constructed in accordance with the teachings of the instant invention.

In the trigger device depicted in FIG. 1 conventional parts familiar to one of ordinary skill in the art and forming no part of the claimed invention are omitted for the sake of better clarity and for the purpose of better understanding of the invention.

As a final matter, it is noted that the trigger device of the applicant disclosed in German Patent Application DE 19626077 and U.S. patent application Ser. No. 08/885,365 filed Jun. 30, 1997, now U.S. Pat. No. 5,913,261 is best suited for implementation of the invention. The entire contents of those patent applications are therefore incorporated herein in their entirety by reference.

The weapon illustrated in FIG. 1 includes a hammer 1 having two locking recesses 20, 22. The hammer 1 has a loaded or cocked position and a discharged position and is pivotally mounted for rotational reciprocation between these two positions. The hammer 1 is biased toward the discharged position and is moved toward the loaded position by the recoil force developed when a shot is fired.

The weapon of FIG. 1 also includes a trigger assembly in operative engagement with the hammer 1 to selectively secure the hammer in the loaded position. As explained below, the trigger assembly has a first mode wherein the trigger assembly permits the hammer to move from the discharged position through the loaded position and back to the discharged position without interference. It also has a second mode wherein the trigger assembly secures the hammer in the loaded position when the hammer moves from the discharged position to the loaded position. The trigger assembly includes a trigger lever 2, a trigger 3 and a trigger lever spring 7.

The hammer 1 is situated in the cocked position in FIG. 1. The cocked position is defined by the trigger lever 2. In particular, the front tip of the trigger lever 2 engages into the rear recess 20 of the two locking recesses 20, 22 of the hammer 1 to thereby secure the hammer in the cocked position. The biasing force applied to the hammer 1 then forces the trigger lever 2 rearwardly against the action of the trigger lever spring 7. As shown in FIG. 1, the trigger lever spring 7 is mounted within a bore defined in the trigger lever 2 and the trigger 3. The trigger lever 2 has an elongated hole 24 with which it is mounted for both lengthwise (i.e., longitudinal) movement and rotational movement around the pivot post 23 of the trigger 3.

In FIG. 1, the trigger 3 is shown situated in its rest position in which it is prevented from pivoting farther forward around the pivot post 23. As also shown in FIG. 1, the trigger 3 includes a protrusion 28 on its upper, rear (proximal) end. The rear (proximal) end of the trigger lever 2 sits on the protrusion 28 with its terminal surface in contact with an abutment of the trigger 3 when the trigger assembly is in the position shown in FIG. 1. For this reason, the trigger lever 2 cannot yield to the torque applied by the hammer 1 which, as mentioned above, loads the trigger lever 2 from the front end.

If the trigger 3 is now moved in the rearward direction, (i.e., pulled), the protrusion 28 of the trigger 3 presses against the rear end of the trigger lever 2 such that the front end of the trigger lever 2 pivots downward. This downward movement causes the front end of the trigger lever 2 to emerge from the locking recess 20 of the hammer 1. Consequently, the hammer 1 is released and free to pivot forward toward the discharged position (i.e., to strike).

At the moment at which the trigger lever 2 is released from the hammer recess 20, it is forced forward and upward by the trigger lever spring 7. Therefore, the front end of the trigger lever 2 moves upward and the rear end of the trigger lever 2 slides off of the protrusion 28 of the trigger 3. The trigger lever 2 then assumes an oblique position so that its front end slides along the undersurface of the hammer 1.

In the meantime, the hammer 1 strikes the firing pin of a breech (not shown), the cartridge is ignited and the breech is moved rearward so that it re-cocks the hammer 1 (i.e., moves the hammer clockwise as seen in FIG. 1 from the discharged position to the loaded position). The rear locking recess 20 of the hammer 1 then runs past the front end of the trigger lever 2. The hammer 1 subsequently reaches its dead point and reverses its direction of motion, since in the meantime the breech has also moved forward again. The rear locking recess 20 then engages the front end of the trigger lever 2 and forces the trigger lever 2 in a rearward direction. The trigger lever 2 moves rearwardly until its rear end abuts against the front surface of the protrusion 28 of the trigger 3, which is still pulled.

If the trigger 3 is subsequently released, it returns to the position depicted in FIG. 1. As it returns to that position, the protrusion 28 dips beneath the rear end of the trigger lever 2, and the trigger lever 2 is then moved further rearwardly by the hammer 1 so that the rear end of the lever 2 again sits above the protrusion 28 in the position shown in FIG. 1.

With the features described above, the weapon can only be fired in single shots. In other words, after every shot, the trigger lever 2 will preform its longitudinal and rotational movement to interrupt the rotational reciprocation of the hammer 1 by securing the hammer in the loaded position shown in FIG. 1.

As also illustrated in FIG. 1, the hammer 1 also has a front locking recess into which a locking device 31 can engage. The locking device 31 is designed as part of a release 5. The release 5 is mounted on the front, top part of the handle of the weapon, and protrudes upwardly into the motion path of the breech (not shown).

If the hammer 1 is now cocked by the rearward moving breech, the front locking recess 22 passes over and falls into engagement with the locking device 31 after the dead point is reached and the hammer 1 has reversed its direction of motion. Then, when the breech reaches its frontmost position, it strikes against the release 5 to thereby cause the hammer 1 to strike. In other words, the release 5 and the locking device 31 act to control the timing of the hammer reciprocation relative to the breech movement when the weapon is operating in a multi-shot, automatic mode.

If, however, the aforementioned single-shot device (i.e., the trigger lever 2 and trigger spring 7) is operative when the breech strikes the release 5, the hammer 1 only moves a short distance before the front end of the trigger lever 2 falls into the rear locking recess 20 and the hammer 1 is secured in the loaded position shown in FIG. 1.

For the purpose of controlling the operation of the trigger assembly, the weapon is further provided with a slide. The slide 4 is mounted for substantially longitudinal, reciprocating movement within the handle between a proximal position and a distal position. The slide 4 is perforated by a bore. A shot selection shaft 12 is disposed within the bore. The shot selection shaft 12 has cams on its outer surface that can engage with the walls of the perforation. In a first angular position of the shot selection shaft 12 (i.e., the sustained firing position) the slide 4 is situated in its rear position and is secured there. In a second angular position of the shot selection shaft 12 (i.e., the single-shot position), the slide 4 can be moved in the longitudinal direction over a certain zone.

As shown in FIG. 1, the lower, front portion of the slide 4 comprises a downwardly extending slide finger **4*b*. The slide finger 4*b* is disposed within a recess defined in the trigger lever 2**.

When the slide 4 is in the single-shot state, the trigger lever 2 can be moved unhampered in its longitudinal direction to effect the interruption process (i.e., to interrupt the reciprocation of the hammer 1 such that the hammer 1 is secured in the loaded position shown in FIG. 1). In this case, an arm spring 11 acts against forward movement of the slide 4 and the trigger lever 2 with its upper arm, but this spring force is overcome by the stronger force associated with the trigger lever spring 7.

If, on the other hand, the slide 4 is secured in its rear position (i.e., the weapon is in the sustained fire position), then the slide finger **4*b* secures the trigger lever 2 against longitudinal movement so that it can only pivot but cannot move in the longitudinal direction. If trigger 3 is pulled with the slide 4 so secured, the trigger lever 2 pivots so that engagement with the hammer 1 is terminated. Since the trigger lever 2 cannot move forward under the influence of the trigger lever spring 7, the trigger lever 2 remains in engagement with the trigger 3, and cannot pivot back. As a result, the trigger lever 2 cannot interfere with the rotational reciprocation of the hammer 1 between the loaded and discharged positions for as long as the trigger 3 remains pulled (or until the slide is released from its proximal position as explained below). When the slide lever 2 is restrained in this manner, control of the striking process (i.e, the timing of the hammer reciprocation relative to the breech movement) is assumed by the interaction of the breech with the release 5** as explained above.

The above description describes the design of the proven trigger device of the applicant. The following description explains a modification that adapts the weapon to ensure only two shots are fired for one actuation of the trigger 3 when the weapon is in the automatic sustained fire mode.

In accordance with an aspect of the invention, the hammer 1 is provided with a hammer protrusion 1*a*. The radius of the motion path of this protrusion 1*a* is greater than that of the remainder of the hammer 1.

For the purpose of selecting the mode of the trigger assembly, the weapon is further provided with a mode control assembly. As described in detail below, the mode control assembly comprises the slide 4, a holding catch 10, and a movable contact.

As shown in FIG. 1, the rear end of the holding catch 10 is mounted for pivoting movement about a bearing pin 13 between a first position wherein the catch 10 secures the slide 4 in the proximal position, and a second position wherein the catch 10 permits the slide 4 to reciprocate between the proximal and distal positions. The holding catch 10 is biased downward (i.e., toward the first position) by the second, lower arm of the torsion spring 11.

A movable contact or detent 8 is pivotally mounted adjacent the front end of the holding catch 10. The movable contact 8 is pivoted forward by a detent spring 9 which, in turn, lies against the holding catch 10. In the position shown in FIG. 1, the detent 8 extends into the motion path of the hammer protrusion 1*a*.

The holding catch 10 has on its front bottom a downwardly extending holding catch hook 10*a*. In the position shown in FIG. 1, the catch hook 10*a* engages in front of a slide support 4*a* of the slide 4 and, thus, secures the slide 4 in its rear position, the slide 4 is, however, capable of moving forward in the depicted position of the shot selection shaft 12 as explained below.

If (in the position depicted in FIG. 1) the trigger 3 is now pulled, the hammer 1 strikes (i.e., moves counterclockwise) and is re-cocked after releasing a round (i.e., moves clockwise). The hammer protrusion 1*a* then passes the upward facing slope of the detent 8 thereby forcing the detent 8 temporarily into the holding catch 10 under the influence of detent spring 9. When the protrusion 1*a* passes the detent 8, the detent immediately resumes the position shown in FIG. 1 under the influence of the spring 9.

Since the slide 4 and, therefore, the trigger lever 2 cannot be moved forward, after it has been released from the locking device 31, the hammer 1 re-strikes the trigger lever 2 and almost simultaneously entrains the detent 8 with the hammer protrusion 1*a*. The detent 8 is pivoted out together with the holding catch 10 on which it is mounted upward from the motion path of the hammer protrusion 1*a* so that the holding catch hook 10*a* is raised upward above the slide support 4*a*. The hammer 1 continues to move forward toward its discharged position so that it fires a second shot. Meanwhile, the slide 4, which is no longer secured by the slide support 4*a*, is forced forward by the compression spring 7 over the trigger lever 2 and the trigger lever 2 can assume its front position to engage the rear recess 20 of the hammer 1, when it subsequently runs against it in the aforementioned manner after the second shot has been fired.

If, after the hammer 1 has engaged the trigger lever 2, the trigger 3 is now released, the hammer 1 pushes the trigger lever 2 back, which again passes over the protrusion 28 of the hammer 1. The torsion spring 11 then pulls the slide 4 back to its proximal position and the holding catch hook 10*a* falls downward again in front of the slide support 4*a* , since the holding catch 10 is pressed downward by the spring 11. The weapon is thus returned to its initial sate wherein, upon repulling of the trigger 3, a repeated two-shot burst will be released as explained above.

The shot selection shaft 12 has on its top a recess which is dimensioned to receive a protrusion 34 on the bottom of the holding catch 10. If the shot selection shaft 12 is rotated from the position shown in FIG. 1, this protrusion 34 and, thus, the holding catch 10 are forced upward into a position in which the detent 8 is held out of the motion path of the hammer protrusion 1*a*. The slide 4 can, therefore, be secured in the rear sustained firing position (i.e., its proximal position) by the corresponding angular position of the shot selection shaft 12 or be released to longitudinal movement for single-shot firing depending on the angular position of the shaft 12.

The shot selection shaft 12 also has on its bottom a recess into which an extension (not shown) on the rear upper end of the trigger 3 can enter. If the shot selection shaft 12 is rotated so that this engagement is no longer possible, trigger 3 is blocked and the weapon thus secured.

Figure 2:
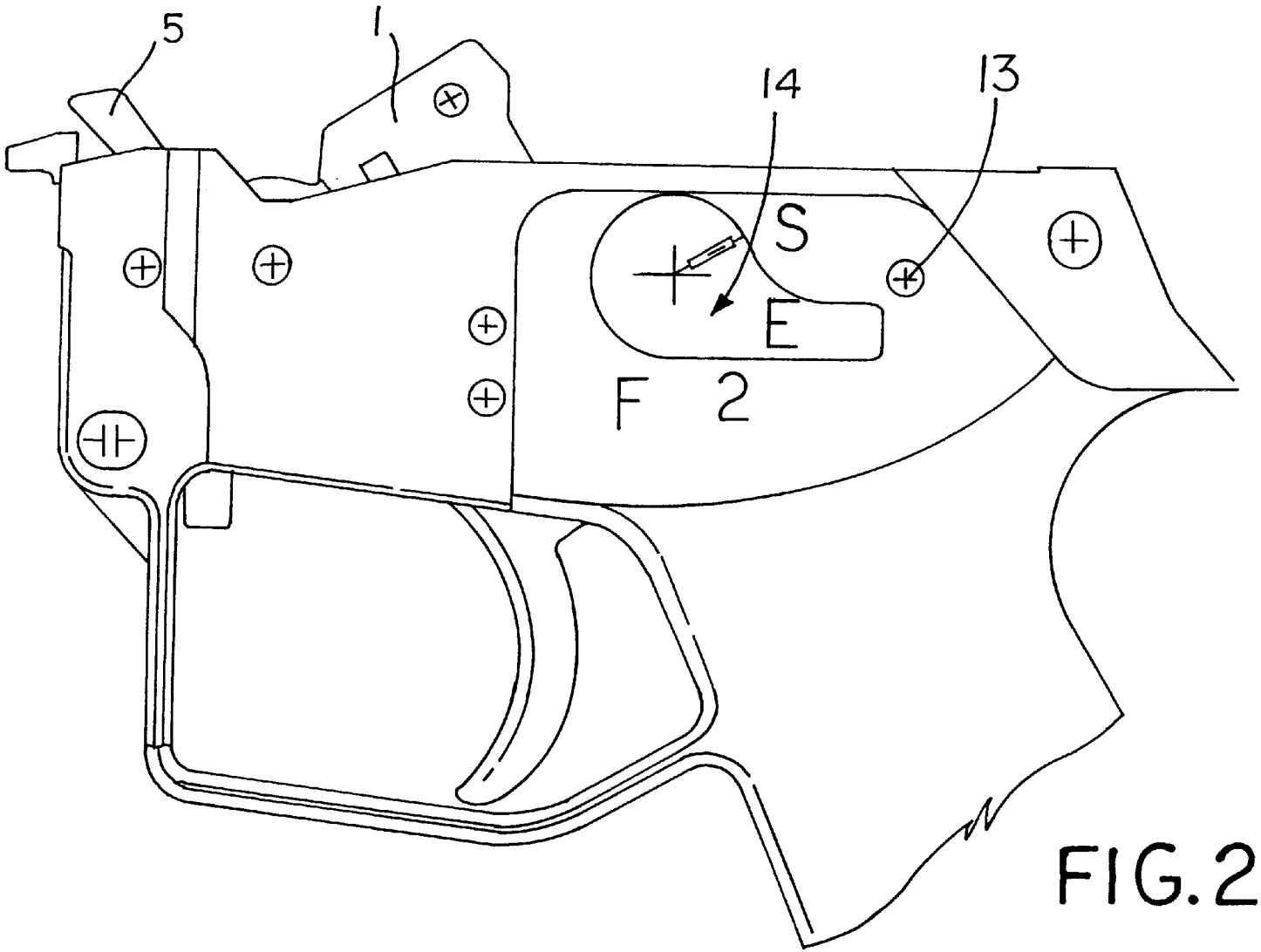
FIG. 2 shows a partial outer view of the handle of FIG. 1.

A shot selection lever 14 is shown in FIG. 2. The shot selection lever 14 sits rigidly on the end of the shot selection shaft 12 and can move alternately into the position "S" (safe), "E" (single-shot), "2" (two-shot) and "F" (sustained fire). The numeral 13 denotes a mounting pin for the holding catch 10.

From the foregoing, persons of ordinary skill in the art will appreciate that the disclosed weapon is adapted to selectively release a reliably short burst of shots. The disclosed apparatus reduces the known three-shot burst to two shots, and does so without any additional mechanism. The operation of the disclosed weapon is controlled by the movement of a functional part, which automatically converts the weapon to single-shot operation after release of the first round in sustained firing so that after a second shot occurs, firing is interrupted.

As will be appreciated by persons of ordinary skill in the art, the disclosed device has the prerequisite that the single-shot device does not require the release of a trigger pulled in sustained firing in order to be operated (as for example in the G3 weapon of the German army). Therefore, the disclosed apparatus may not be implemented in all known trigger devices without additional modification of the existing components.

As already mentioned above, the functional part can be versatile. In an ordinary weapon in which the firing pin is rigidly connected to the breech, the breech would be the most expedient functional part. In a weapon having a hammer, the breech could also be used as the functional part. In this type of weapon, however, it is most advantageous according to the invention to use the hammer itself as the functional part which activates the single shot device, because it is situated closest to the single-shot device being engaged.

It should also be noted that the switching process to a single shot operation does not occur so soon that there is a hazard that the single-shot device will interrupt the motion required to release a second round after firing of the first round. The shooter can, therefore, rely on the fact that two rounds are actually released in a weapon that is set at "two-shot". However, if the hammer itself is used as functional part, the time of engagement of the single-shot device can be determined simply by design without adding tolerances as would be possible during transfer from a functional part lying farther away.

Persons of ordinary skill in the art will appreciate that, although the holding catch 10 can be mounted loosely so that it is capable of avoiding the hammer 1 during its backward motion (cocking motion), it is of particular advantage if the holding catch 10 has a detent 8 designed so that it avoids the hammer 1 during its cocking motion, but which is engaged by the hammer 1 during its striking motion and carried along until the hammer 1 is released from engagement with the detent 8 as a result of the circular path that it covers.

After the holding catch 10 is pivoted by the entrained detent 8 and has released the slide 14, it is moved back to its initial position by a spring 11 in order to be able to engage behind the slide 4 again when the trigger lever 2 holds the hammer 1 cocked after the second round. If the trigger 3 is now released and pulled back again, the described process repeats to release two rounds. To permit sustained fire, the holding catch 10 must, therefore, be pivoted out from engagement with the slide 4 and held in this pivoted out position.

For this purpose it is particularly advantageous to use a known shot selection shaft 12, which carries an operating lever on one or both ends and which can pass through the slide 4 so that it can permit movement of the slide 4 for a single shot through protrusions on its outside as a function of its rotational position and prevents sustained fire.

In this case, either the holding catch 10 advantageously has a protrusion and the shot selection shaft 12 a mating recess or the holding catch 10 has a recess and the shot selection shaft 12 has a mating protrusion. In either event, the protrusion and recess are arranged so that the corresponding protrusion falls into the corresponding recess when the shot selection shaft 12 is still situated in a position in the single-shot area. By falling in, the holding catch 10 is permitted to engage in the slide 4, thereby blocking it. At the same time a locking position for the operating lever is created. If this is pivoted farther, the shot selection shaft 12 is rotated and the protrusion of the holding catch 10 runs on the outer periphery of the shaft 12 or the protrusion of the shaft 12 on the outer edge of the holding catch 10 so that the catch 10 pivots out from the shot selection shaft 12 and, thus, out from engagement with the slide 4 and becomes inoperative in so doing.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use in an automatic self-loading weapon, an apparatus comprising:

a trigger assembly which, when its motion is unimpeded, will release a single round for each actuation of an associated trigger;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever is secured against movement to thereby impede at least one movement of the trigger assembly such that the trigger assembly will release two rounds for each actuation of the associated trigger;

a catch in operative engagement with the first lever to selectively convert the state of the first lever between the first and the second states; and an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger.

2. An apparatus as defined in claim 1 wherein the actuator comprises a projection on a hammer.

3. An apparatus as defined in claim 1 wherein the trigger assembly includes a trigger lever that is mounted to pivot with the trigger and to move longitudinally with respect to the trigger, and wherein the first lever prevents the trigger lever from moving longitudinally but permits pivoting of the trigger lever when the first lever is in the second state.

4. An apparatus as defined in claim 1 wherein the first lever comprises a slide, wherein the catch selectively secures the slide against movement to define the second state of the first lever, and wherein the catch is positioned to be displaced by a hammer to release the slide such that the state of the first lever changes from the second state to the first state.

5. An apparatus as defined in claim 1 further comprising a contact positioned within the motion path of a hammer and a spring disposed between the contact and the catch such that the contact can be forced out of the motion path during a cocking motion of the hammer and can be entrained by the hammer during a striking motion of the hammer to displace the catch and to thereby convert the state of the first lever from the second state to the first state.

6. An apparatus as defined in claim 1 further comprising a shot selection shaft, the position of the shot selection shaft defining the state of the first lever.

7. An apparatus as defined in claim 6 wherein the catch has a protrusion that lies against the shot selection shaft, wherein the shot selection shaft has a recess dimensioned to receive the protrusion, and wherein the protrusion is disposed within the recess when the shot selection shaft is disposed in an intermediate position between a sustained firing position and a single shot position.

8. An apparatus as defined in claim 6 wherein the shot selection shaft has a single shot position wherein the shot selection shaft holds the catch out of engagement with the first lever such that the first lever remains in the first state.

9. An automatic firearm comprising:

a hammer for reciprocating between a loaded position and a discharged position, the hammer being biased toward the discharged position;

a trigger assembly in operative engagement with the hammer to selectively secure the hammer in the loaded position, the trigger assembly having a first mode wherein the trigger assembly permits the hammer to move from the discharged position through the loaded position and back to the discharged position without interference, and a second mode wherein the trigger assembly secures the hammer in the loaded position when the hammer moves from the discharged position to the loaded position;

a mode control assembly in cooperative engagement with the trigger assembly, the mode control assembly including a lever and a catch, the catch being movable through a first distance relative to the lever to select the mode of the trigger assembly; and an actuator cooperating with the catch of the mode control assembly to move the catch through the first distance to selectively convert the mode of the trigger assembly from the first mode to the second mode after discharge of a first shot to thereby ensure two shots are fired for one actuation of the trigger assembly, wherein the actuator moves the catch through the first distance one time for two cycles of the hammer from the loaded position to the discharge position and back to the loaded position to convert the mode of the trigger assembly from the first mode to the second mode.

10. A firearm as defined in claim 9 wherein the mode control assembly has a two shot state wherein the mode control assembly converts the mode of the trigger assembly from the first mode to the second mode, and the mode control assembly has a single shot state wherein the mode control assembly maintains the trigger assembly in the second mode.

11. A firearm as defined in claim 9 wherein the trigger assembly further comprises:

a trigger;

a trigger lever having a first condition wherein the movement of the trigger lever has only a rotational component, and a second condition wherein the movement of the trigger lever has both a rotational component and a longitudinal component; and a trigger lever spring biasing the trigger lever into engagement with the hammer.

12. A firearm as defined in claim 9 wherein the actuator comprises a projection on the hammer.

13. A firearm as defined in claim 9 wherein the mode control assembly further comprises:

a slide mounted for movement between a proximal position and a distal position, wherein the slide secures the trigger assembly in the first mode when the slide is secured in the proximal position;

a catch mounted for movement between a first position wherein the catch secures the slide in its proximal position, and a second position wherein the catch permits the slide to reciprocate between its proximal and distal positions; and a movable contact cooperating with the actuator and the catch to selectively move the catch from the first position to the second position to convert the mode of the trigger assembly from the first mode to the second mode.

14. A firearm as defined in claim 13 wherein the trigger assembly further comprises:

a trigger;

a trigger lever having a first condition wherein the movement of the trigger lever has only a rotational component, and a second condition wherein the movement of the trigger lever has both a rotational component and a longitudinal component; and a trigger lever spring biasing the trigger lever into engagement with the hammer.

15. A firearm as defined in claim 14 wherein the slide is in cooperative engagement with the trigger lever to secure the trigger lever in the first condition when the slide is secured in the proximal position.

16. A firearm as defined in claim 13 further comprising a first spring biasing the slide toward the proximal position.

17. A firearm as defined in claim 16 wherein the first spring biases the catch toward the first position.

18. A firearm as defined in claim 13 wherein the movable contact is coupled to the catch through a second spring.

19. A firearm as defined in claim 13 further comprising a shot selection shaft in operative engagement with the catch, the shot selection shaft having a first shaft position wherein the catch is secured in the second position and a second shot shaft position wherein the catch is free to move between the first and the second positions.

20. A firearm as defined in claim 19 wherein when the shaft secures the catch in the second position, the trigger assembly is secured in the second mode such that the firearm discharges only one shot for each actuation of the trigger assembly.

21. For use in an automatic self-loading weapon, an apparatus comprising:

a trigger assembly which, when its motion is unimpeded, will release a single round for each actuation of an associated trigger;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever impedes at least one movement of the trigger assembly;

a catch in operative engagement with the first lever to selectively convert the state of the first lever between the first and the second states; and an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger, and wherein the actuator comprises a projection on a hammer.

22. For use in an automatic self-loading weapon, an apparatus comprising:

a trigger assembly which, when its motion is unimpeded, will release a single round for each actuation of an associated trigger;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever impedes at least one movement of the trigger assembly;

a catch in operative engagement with the first lever to selectively convert the state of the first lever between the first and the second states; and an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger;

wherein the trigger assembly includes a trigger lever that is mounted to pivot with the trigger and to move longitudinally with respect to the trigger, and wherein the first lever prevents the trigger lever from moving longitudinally but permits pivoting of the trigger lever when the first lever is in the second state.

23. For use in an automatic self-loading weapon, an apparatus comprising:

a trigger assembly which, when its motion is unimpeded, will release a single round for each actuation of an associated trigger, a mode control assembly;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever impedes at least one movement of the trigger assembly;

a catch in operative engagement with the first lever to selectively convert the state of the first lever between the first and the second states; and an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger;

wherein the first lever comprises a slide, wherein the catch selectively secures the slide against movement to define the second state of the first lever, and wherein the catch is positioned to be displaced by a hammer to release the slide such that the state of the first lever changes from the second state to the first state.

24. For use in an automatic self-loading weapon, an apparatus comprising:

a trigger assembly which, when its motion is unimpeded, will release a single round for each actuation of an associated trigger;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever impedes at least one movement of the trigger assembly;

a catch in operative engagement with the first lever to selectively convert the state of the first lever between the first and the second states; and an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger; and a contact positioned within the motion path of a hammer and a spring disposed between the contact and the catch such that the contact can be forced out of the motion path during a cocking motion of the hammer and can be entrained by the hammer during a striking motion of the hammer to displace the catch and to thereby convert the state of the first lever from the second state to the first state.

25. For use in an automatic self-loading weapon, an apparatus comprising:

a trigger assembly which, when its motion is unimpeded, will release a single round for each actuation of an associated trigger;

a first lever in operative engagement with the trigger assembly, the first lever having a first state wherein the first lever moves with the trigger assembly without impeding the motion thereof such that the trigger assembly will release a single round for each actuation of the associated trigger, the first lever having a second state wherein the first lever impedes at least one movement of the trigger assembly;

a catch in operative engagement with the first lever to selectively convert the state of the first lever between the first and the second states;

an actuator in operative engagement with the catch, wherein when the first lever is in the second state during a first shot, the actuator and the catch cooperate to convert the state of the first lever from the second state to the first state to thereby ensure that only two rounds are released for a single actuation of the trigger; and a shot selection shaft, the position of the shot selection shaft defining the state of the first lever;

wherein the catch has a protrusion that lies against the shot selection shaft, wherein the shot selection shaft has a recess dimensioned to receive the protrusion, and wherein the protrusion is disposed within the recess when the shot selection shaft is disposed in an intermediate position between a sustained firing position and a single shot position.

26. An apparatus as defined in claim 25 wherein the shot selection shaft has a single shot position wherein the shot selection shaft holds the catch out of engagement with the first lever such that the first lever remains in the first state.

27. An automatic firearm comprising:

a hammer for reciprocating between a loaded position and a discharged position, the hammer being biased toward the discharged position;

a trigger assembly in operative engagement with the hammer to selectively secure the hammer in the loaded position, the trigger assembly having a first mode wherein the trigger assembly permits the hammer to move from the discharged position through the loaded position and back to the discharged position without interference, and a second mode wherein the trigger assembly secures the hammer in the loaded position when the hammer moves from the discharged position to the loaded position, the trigger assembly including: (a) a trigger, (b) a trigger lever having a first condition wherein the movement of the trigger lever has only a rotational component, and a second condition wherein the movement of the trigger lever has both a rotational component and a longitudinal component, and (c) a trigger lever spring biasing the trigger lever into engagement with the hammer;

a mode control assembly in cooperative engagement with the trigger assembly to select the mode of the trigger assembly; and an actuator cooperating with the mode control assembly to selectively convert the mode of the trigger assembly from the first mode to the second mode after discharge of a first shot to thereby ensure two shots are fired for one actuation of the trigger assembly.

28. An automatic firearm comprising:

a hammer for reciprocating between a loaded position and a discharged position, the hammer being biased toward the discharged position;

a trigger assembly in operative engagement with the hammer to selectively secure the hammer in the loaded position, the trigger assembly having a first mode wherein the trigger assembly permits the hammer to move from the discharged position through the loaded position and back to the discharged position without interference, and a second mode wherein the trigger assembly secures the hammer in the loaded position when the hammer moves from the discharged position to the loaded position;

a mode control assembly in cooperative engagement with the trigger assembly to select the mode of the trigger assembly; and an actuator cooperating with the mode control assembly to selectively convert the mode of the trigger assembly from the first mode to the second mode after discharge of a first shot to thereby ensure two shots are fired for one actuation of the trigger assembly, wherein the actuator comprises a projection on the hammer.

29. An automatic firearm comprising:

a hammer for reciprocating between a loaded position and a discharged position, the hammer being biased toward the discharged position;

a trigger assembly in operative engagement with the hammer to selectively secure the hammer in the loaded position, the trigger assembly having a first mode wherein the trigger assembly permits the hammer to move from the discharged position through the loaded position and back to the discharged position without interference, and a second mode wherein the trigger assembly secures the hammer in the loaded position when the hammer moves from the discharged position to the loaded position;

a mode control assembly in cooperative engagement with the trigger assembly to select the mode of the trigger assembly;

an actuator cooperating with the mode control assembly to selectively convert the mode of the trigger assembly from the first mode to the second mode after discharge of a first shot to thereby ensure two shots are fired for one actuation of the trigger assembly; and wherein the mode control assembly further comprises:

a slide mounted for movement between a proximal position and a distal position, wherein the slide secures the trigger assembly in the first mode when the slide is secured in the proximal position;

a catch mounted for movement between a first position wherein the catch secures the slide in its proximal position, and a second position wherein the catch permits the slide to reciprocate between its proximal and distal positions; and a movable contact cooperating with the actuator and the catch to selectively move the catch from the first position to the second position to convert the mode of the trigger assembly from the first mode to the second mode.

30. A firearm as defined in claim 29 wherein the trigger assembly further comprises:

a trigger;

a trigger lever having a first condition wherein the movement of the trigger lever has only a rotational component, and a second condition wherein the movement of the trigger lever has both a rotational component and a longitudinal component; and a trigger lever spring biasing the trigger lever into engagement with the hammer.

31. A firearm as defined in claim 30 wherein the slide is in cooperative engagement with the trigger lever to secure the trigger lever in the first condition when the slide is secured in the proximal position.

32. A firearm as defined in claim 29 further comprising a first spring biasing the slide toward the proximal position.

33. A firearm as defined in claim 32 wherein the first spring biases the catch toward the first position.

34. A firearm as defined in claim 29 wherein the movable contact is coupled to the catch through a second spring.

35. A firearm as defined in claim 29 further comprising a shot selection shaft in operative engagement with the catch, the shot selection shaft having a first shaft position wherein the catch is secured in the second position and a second shot shaft position wherein the catch is free to move between the first and the second positions.

36. A firearm as defined in claim 35 wherein when the shaft secures the catch in the second position, the trigger assembly is secured in the second mode such that the firearm discharges only one shot for each actuation of the trigger assembly.

37. An automatic firearm comprising:

a hammer for reciprocating between a loaded position and a discharged position, the hammer being biased toward the discharged position;

a trigger assembly in operative engagement with the hammer to selectively secure the hammer in the loaded position, the trigger assembly having a first mode wherein the trigger assembly permits the hammer to move from the discharged position through the loaded position and back to the discharged position without interference, and a second mode wherein the trigger assembly secures the hammer in the loaded position when the hammer moves from the discharged position to the loaded position;

a mode control assembly in cooperative engagement with the trigger assembly to convert the mode of the trigger assembly without employing a ratchet wheel; and an actuator cooperating with the mode control assembly to selectively convert the mode of the trigger assembly from the first mode to the second mode after discharge of a first shot to thereby ensure two shots are fired for one actuation of the trigger assembly.

* * * * *